US008953315B2

(12) United States Patent
Takemoto et al.

(10) Patent No.: US 8,953,315 B2
(45) Date of Patent: Feb. 10, 2015

(54) AXIAL FAN AND ELECTRONIC DEVICE INCLUDING THE SAME

(75) Inventors: Shinji Takemoto, Kyoto (JP); Yoshiaki Oguma, Kyoto (JP); Ryosuke Ishida, Kyoto (JP)

(73) Assignee: Nidec Corporation, Kyoto (JP)

( * ) Notice: Subject to any disclaimer, the term of this patent is extended or adjusted under 35 U.S.C. 154(b) by 462 days.

(21) Appl. No.: 13/185,523

(22) Filed: Jul. 19, 2011

(65) Prior Publication Data

US 2012/0026688 A1 Feb. 2, 2012

(30) Foreign Application Priority Data

Jul. 30, 2010 (JP) ..... 2010-171407

(51) Int. Cl.
*H05K 7/20* (2006.01)
*F04D 29/58* (2006.01)

(52) U.S. Cl.
CPC ..... *F04D 29/582* (2013.01)
USPC .. 361/695; 361/694; 361/679.48; 361/679.49

(58) Field of Classification Search
USPC ..... 361/694, 695, 679.48, 679.49
See application file for complete search history.

(56) References Cited

U.S. PATENT DOCUMENTS 5,288,203 A * 2/1994 Thomas ..... 165/80.3
5,707,205 A * 1/1998 Otsuka ..... 415/119
6,132,171 A 10/2000 Fujinaka et al.
6,179,562 B1 1/2001 Fujinaka
6,332,755 B1 12/2001 Fujinaka et al.
6,406,258 B1 * 6/2002 Lin et al. ..... 415/213.1
6,710,486 B1 * 3/2004 Horng et al. ..... 310/89
7,063,504 B2 * 6/2006 Huang et al. ..... 415/165
7,223,068 B2 * 5/2007 Horng et al. ..... 415/187
7,775,767 B2 * 8/2010 Takemoto et al. ..... 415/211.2
7,835,149 B2 * 11/2010 Li et al. ..... 361/679.49
8,068,339 B2 * 11/2011 Kayama et al. ..... 361/695

(Continued)

FOREIGN PATENT DOCUMENTS

JP 01-249982 A 10/1989
JP 04-183998 A 6/1992
JP 11-218098 A 8/1999
JP 2001-003900 A 1/2001
WO 2009/057063 A2 5/2009

OTHER PUBLICATIONS

Takemoto, "Axial Fan and Slide Mold", U.S. Appl. No. 13/191,519, filed Jul. 27, 2011.

*Primary Examiner* — Jayprakash N Gandhi
(74) *Attorney, Agent, or Firm* — Keating & Bennett, LLP

(57) ABSTRACT

In an axial fan, a housing includes a side wall arranged to surround an outer circumference of an impeller, and a substantially square or substantially rectangular flange arranged to project radially outward from an outer circumferential surface of the side wall. The side wall preferably includes three slit groups each including a plurality of slits arranged in a circumferential direction and arranged to extend through the side wall from an inner circumferential surface to the outer circumferential surface thereof. Two of the slit groups are defined in portions of the side wall which correspond to two adjacent corner portions in an upper half portion of the flange, while the remaining slit group is defined in a portion of the side wall which corresponds to a lower half portion of the flange. The upper and lower half portions are divided at a line parallel or substantially parallel to two opposing sides of the flange and passing through a central axis.

10 Claims, 12 Drawing Sheets

(56) References Cited

U.S. PATENT DOCUMENTS

| | | | | |
|---|---|---|---|---|
| 8,451,605 | B2 * | 5/2013 | Chen | 361/695 |
| 8,520,383 | B2 * | 8/2013 | Park | 361/695 |
| 2002/0028137 | A1 | 3/2002 | Fujinaka et al. | |
| 2008/0225480 | A1 * | 9/2008 | Kayama et al. | 361/695 |
| 2008/0259564 | A1 | 10/2008 | Kayama et al. | |
| 2010/0209264 | A1 | 8/2010 | Takemoto et al. | |
| 2011/0305565 | A1 | 12/2011 | Kayama et al. | |
| 2012/0027577 | A1 * | 2/2012 | Takemoto | 415/203 |

* cited by examiner

AXIAL FAN AND ELECTRONIC DEVICE INCLUDING THE SAME

BACKGROUND OF THE INVENTION

1. Field of the Invention

The present invention relates to an axial fan and an electronic device including the same.

2. Description of the Related Art

Axial fans whose housings include slits have been known. For example, World Intellectual Property Organization Publication No. 2009/057063 discloses one such conventional axial fan. This conventional axial fan includes an impeller in which a plurality of blades are arranged in a circumferential direction about a central axis, and a housing (i.e., a wind tunnel portion) arranged radially outward of the impeller to surround the impeller. The housing includes a plurality of slits that are arranged in the circumferential direction and arranged to extend through the housing from an inner circumferential surface to an outer circumferential surface thereof.

The conventional axial fan as described above is often used as a cooling fan for an electronic device or the like, and is often attached to an exhaust duct provided in a casing of an electronic device or the like to define an air channel in the casing. In this case, the axial fan is sometimes attached to the duct such that an outer circumference of the axial fan is covered by a surface of the duct depending on the shape of the duct. In this case, the slits will be covered by the presence of the surface of the duct on the outside of the axial fan. When this happens, inflow of air into the housing through the slits is blocked, which thus makes it impossible to increase an air volume in a surge range, that is, resulting in a failure to make the most of an air intake effect of the slits.

SUMMARY OF THE INVENTION

An axial fan according to a preferred embodiment of the present invention includes an impeller arranged to rotate about a central axis, and including a plurality of blades centered on the central axis, arranged to project radially outward, and arranged in a circumferential direction; and a housing including a side wall arranged to have openings at both axial ends thereof and arranged to surround an outer circumference of the impeller, and a substantially square or substantially rectangular flange arranged to project radially outward from an outer circumferential surface of the side wall. The side wall preferably includes an opening end at the axial end thereof on an inlet side and another opening end at the axial end thereof on an outlet side. The flange is preferably arranged on the opening end on the inlet side or on the opening end on the outlet side. The side wall preferably includes three slit groups each of which includes a plurality of slits arranged to extend in the circumferential direction and arranged to extend through the side wall from an inner circumferential surface to the outer circumferential surface thereof. Two of the slit groups are defined in portions of the side wall which correspond to two adjacent corner portions in an upper half portion of the flange, while the remaining slit group is defined in a portion of the side wall which corresponds to a lower half portion of the flange. The upper and lower half portions are divided at a line parallel or substantially parallel to two opposing sides of the flange and passing through the central axis.

According to the above-described preferred embodiment, a gap S1 is preferably defined between a duct and an outside of each portion of the side wall which corresponds to a corner portion of the flange. Therefore, entry of a sufficient amount of air is accomplished through the two slit groups defined in the portions of the side wall which correspond to the corner portions. In addition, a gap S2 is defined between the duct and an outside of a portion of the side wall which corresponds to a lower side of the flange. Therefore, entry of a sufficiently large amount of air is also accomplished through the slit group defined in the portion of the side wall which corresponds to the lower half portion of the flange. This makes it possible to make the most of an air intake effect of the slits.

An axial fan according to a preferred embodiment of the present invention is also able to achieve a reduction in deterioration of an air volume characteristic in a surge range.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of the present invention will be described in detail with reference to the accompanying drawings. Note that the present invention is not limited to the preferred embodiments described below. Also note that variations and modifications can be made appropriately as long as desired effects of the present invention are not impaired. Also note that the preferred embodiments described below may be combined with other preferred embodiments of the present invention. For the sake of convenience, it is assumed in the following description of the preferred embodiments of the present invention that a vertical direction of each figure is referred to as a "vertical direction". Note, however, that this assumption should not be construed to restrict an orientation of any device or member in actual use. Also note that, for the sake of convenience in description, a direction parallel or substantially parallel to a central axis J1 will be referred to as an axial direction, and a radial direction centered on the central axis J1 will be referred to as a radial direction.

First Preferred Embodiment

A first preferred embodiment of the present invention will now be described below with reference to FIGS. 1-9. An axial fan A according to the present preferred embodiment is preferably arranged to cool an electronic device 200, such as, for example, a household electrical appliance, by discharging an air having a high temperature inside a casing 201 of the electronic device 200 to an outside thereof. Details thereof will be described in further detail below.

Overall Structure

Figure 1:
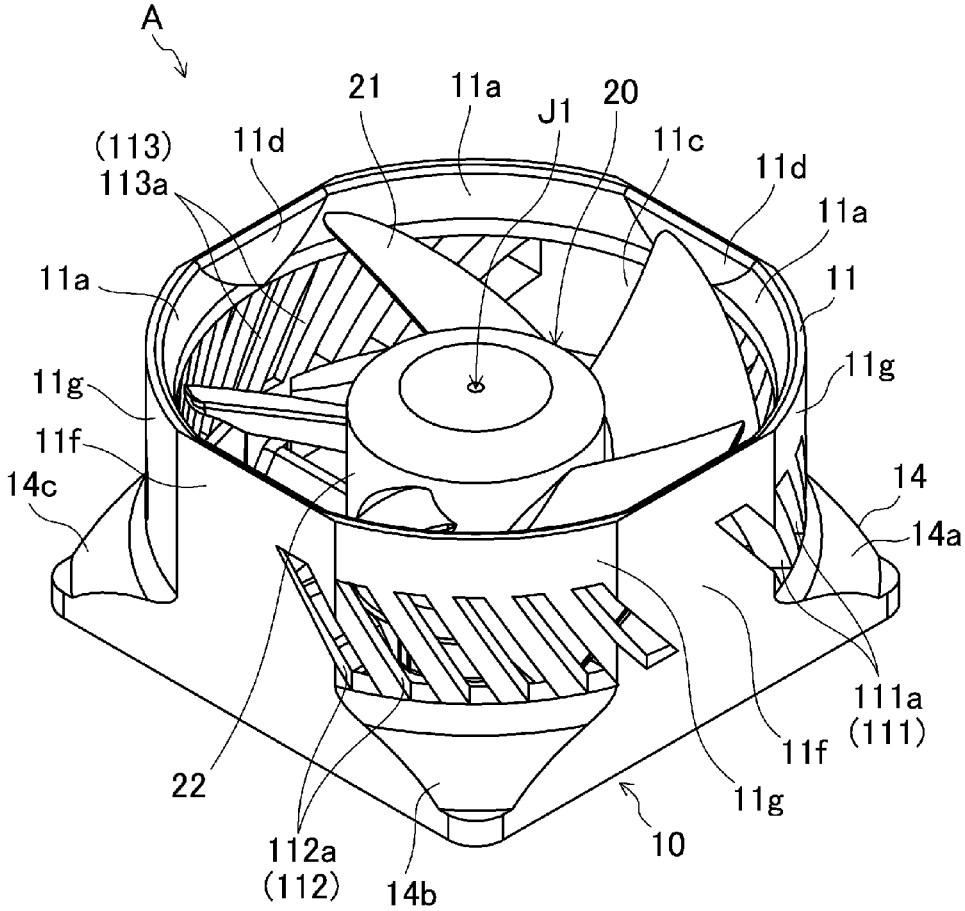
FIG. 1 is a perspective view of an axial fan according to a first preferred embodiment of the present invention as viewed from an inlet side.
Figure 2:
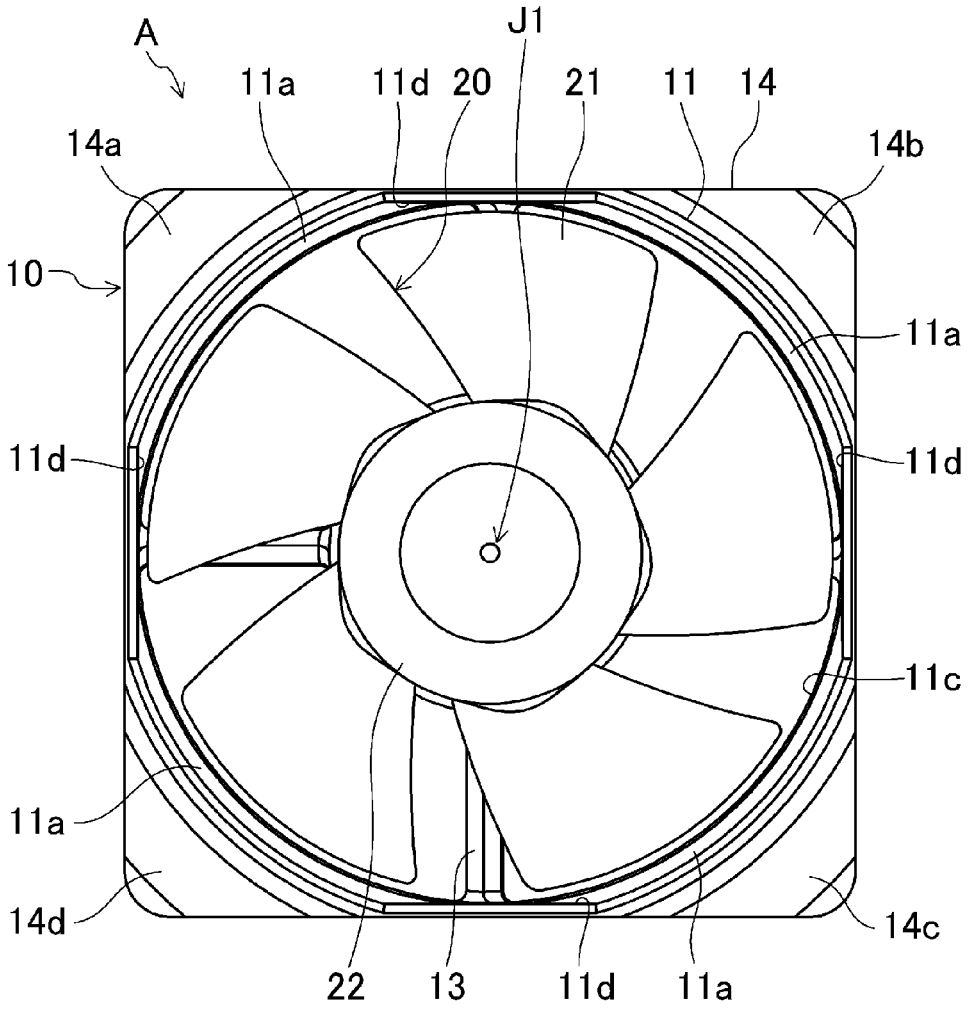
FIG. 2 is a plan view of the axial fan illustrated in FIG. 1 as viewed from the inlet side.
Figure 3:
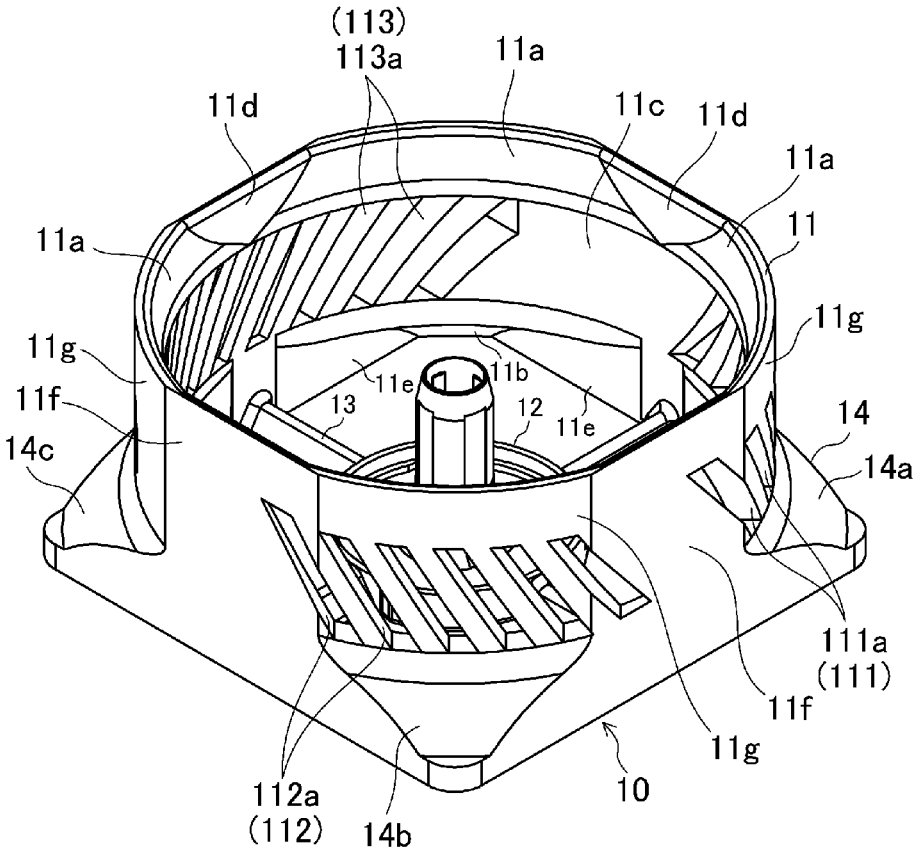
FIG. 3 is a perspective view of the axial fan illustrated in FIG. 1, in which an impeller is not shown.

An overall structure of the axial fan A will now be described below. Referring to FIGS. 1 and 2, the axial fan A includes a housing 10, an impeller 20, and a motor portion arranged to rotate the impeller.

The impeller 20 preferably includes a substantially cylindrical impeller cup portion 22 and a plurality of blades 21. The blades 21 are arranged to rotate about the central axis J1 to produce an air flow. Referring to FIG. 2, the blades 21 are preferably arranged on an outside surface of the impeller cup portion 22 such that the blades 21 are arranged at regular intervals in a circumferential direction about the central axis J1. The blades 21 are arranged to rotate in accordance with rotation of the impeller 20. Rotation of the blades 21 causes an air to be pushed downward (i.e., in a downward direction in FIG. 1). The downward push of the air causes an air flow traveling in a direction parallel or substantially parallel to the central axis J1. Note that, in FIGS. 1 and 3, an upper side and a lower side correspond to an inlet side and an outlet side, respectively.

The motor portion preferably includes a rotor yoke, which is substantially in the shape of a covered cylinder. The impeller 20 is preferably arranged to be attached to an outside surface of the rotor yoke. One end portion of a shaft is joined and fixed to the rotor yoke. The rotor yoke is arranged to rotate with the shaft in a center thereof. A rotation axis of the shaft will be referred to as the central axis J1.

The housing 10 preferably includes a side wall 11, a base portion 12, support ribs 13, and a flange 14. An inner circumferential surface of the side wall 11 is preferably curved and substantially cylindrical, while an external shape of the side wall 11 is preferably flat and substantially square. The side wall 11 preferably defines a hollow tube that includes openings at both axial ends. One opening end of the side wall 11 (i.e., on the upper side in each of FIGS. 1 and 3) is arranged on the inlet side, while the other opening end of the side wall (i.e., on the lower side in each of FIGS. 1 and 3) is arranged on the outlet side. A radially outer periphery of the impeller 20 is preferably arranged to be radially opposite from the inner circumferential surface of the side wall 11. That is, the side wall 11 is arranged to define an air channel for the air flow which is produced when the impeller 20 is rotated about the central axis J1. A radial gap is arranged between the blades and the side wall 11 to prevent the blades 21 from coming into contact with the side wall 11.

The flange 14 is defined integrally with the opening end of the side wall 11 on the outlet side. The flange 14 is preferably substantially square shaped and arranged to project radially outward from an outer circumferential surface of the side wall 11. Note that the flange 14 may be arranged on the opening end of the side wall 11 on the inlet side, instead of on the outlet side, in other preferred embodiments of the present invention.

The outer circumferential surface of the side wall 11 includes side corresponding surfaces 11*f* and corner corresponding surfaces 11*g*. Each of the side corresponding surfaces 11*f* is provided for a separate one of four sides of the flange 14. Each of the corner corresponding surfaces 11*g* is preferably provided for a separate one of four corner portions 14*a* to 14*d* (specifically, a first corner portion 14*a*, a second corner portion 14*b*, a third corner portion 14*c*, and a fourth corner portion 14*d*) of the flange 14. Each side corresponding surface 11*f* is preferably defined by a flat surface, while each corner corresponding surface 11*g* is preferably defined by an arc-shaped surface swelling outward.

The side wall 11 has an upper opening portion at its upper end (on an inlet side), and a lower opening portion at its lower end (on an outlet side). The upper opening portion of the side wall 11 includes inclined surfaces 11*a* and 11*d* defined therein. The inclined surfaces 11*a* and 11*d* are arranged to gradually expand a cross section of the air channel which is perpendicular or substantially perpendicular to the central axis J1 with decreasing distance from the upper end of the side wall 11. In other words, the inclined surfaces 11*a* and 11*d* are arranged to be at increasingly greater distances from the central axis J1 with increasing height in the direction parallel or substantially parallel to the central axis J1. The lower opening portion of the side wall 11 includes inclined surfaces 11*b* and 11*e* defined therein. The inclined surfaces 11*b* and 11*e* are arranged to gradually expand the cross section of the air channel which is perpendicular or substantially perpendicular to the central axis J1 with decreasing distance from the lower end of the side wall 11. In other words, the inclined surfaces 11*b* and 11*e* are arranged to be at increasingly greater distances from the central axis J1 with decreasing height in the direction parallel to the central axis J1.

The inclined surfaces 11*a* and 11*b* are defined in locations which correspond to the corner corresponding surfaces 11*g* in the outer circumferential surface. The inclined surfaces 11*d* and 11*e* are defined in locations which correspond to the side corresponding surfaces 11*f* in the outer circumferential surface. As a result of the inclined surfaces 11*a* and 11*d* being defined as described above, a portion of the side wall 11 at and near the opening end thereof on the inlet side is arranged in a tapered shape so that a cross-sectional area of the opening defined thereby increases with decreasing distance from the opening end on the inlet side. Meanwhile, as a result of the inclined surfaces 11*b* and 11*e* being defined as described above, a portion of the side wall 11 at and near the opening end thereof on the outlet side is arranged in a tapered shape so that a cross-sectional area of the opening defined thereby increases with decreasing distance from the opening end on the outlet side.

Although not shown in the figures, fitting holes are preferably defined in the four corner portions 14*a* to 14*d* of the flange 14. The fitting holes are used to attach the axial fan A to a duct 206 provided inside the electronic device 200, which will be further described below. Each of the fitting holes is preferably arranged to extend in the direction parallel or substantially parallel to the central axis J1 through a corresponding one of the corner portions 14*a* to 14*d*.

A straight surface 11*c* is defined between the inclined surfaces 11*a* and 11*b* in the direction parallel or substantially parallel to the central axis J1. The radial distance between the central axis J1 and the inner circumferential surface of the side wall 11 is substantially constant throughout an entire portion of the inner circumferential surface which corresponds to the straight surface 11*c*. The side wall 11 is preferably defined through, for example, injection molding. The straight surface 11*c* is inclined at a slight angle to the central axis J1 to become more distant from the central axis J1 with increasing height. This slight angle is referred to as a draft angle, and is set in order to facilitate mold release when a molded article is removed from molds. The draft angle scarcely affects the air volume characteristic of the axial fan A.

The base portion 12 is arranged radially inward of the side wall 11 to support and fix the motor portion 30. In more detail, the base portion 12 is arranged at a level corresponding to that of a lower end portion of the side wall 11. The base portion 12 is arranged substantially in the shape of a cylinder having a bottom and centered on the central axis J1. A bearing housing 12*a* arranged substantially in the shape of a cylinder having a bottom and centered on the central axis J1 is arranged in a center of the base portion 12.

The support ribs 13, which are preferably four in number, for example, are arranged on an outside surface of the base portion 12 to project radially outward therefrom. In addition, the four support ribs 13, for example, are preferably arranged in a circumferential direction of the outside surface of the base portion 12, and centered on the central axis J1. Each of the support ribs 13 is joined and connected to the inner circumferential surface of the side wall 11 on a radial outside. In more detail, the support ribs 13 are joined and connected to the inclined surfaces 11*b*, which define portions of the inner circumferential surface of the side wall 11. That is, the base portion 12 is supported by the side wall 11 through the four support ribs 13. The side wall 11, the base portion 12, and the support ribs 13 are defined continuously and integrally with one another through injection molding. A material used in this injection molding preferably is a resin. Note, however, that application of the injection molding using the resin is not essential to the present invention. For example, a die-casting process using an aluminum alloy may be applied to define the side wall 11, the base portion 12, and the support ribs 13 continuously and integrally with each other.

Structure of Slits

Figure 4:
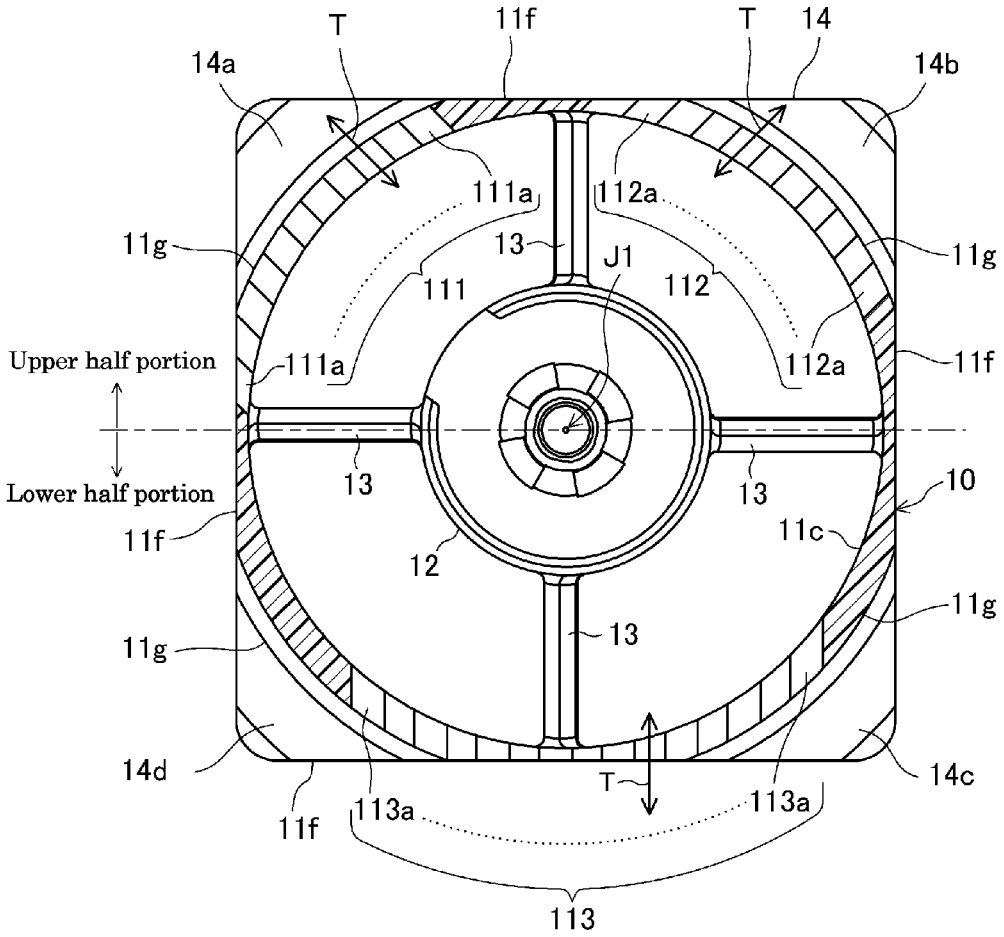
FIG. 4 is a cross-sectional view illustrating a housing of the axial fan according to the first preferred embodiment of the present invention in a cross-section taken along a plane perpendicular to a central axis J1.

Next, slits 111*a*, 112*a*, and 113*a* defined in the side wall 11 of the housing 10 will now be described in detail below with reference to FIGS. 4 to 7. Note that the impeller 20, the motor portion, and so on are not shown in FIG. 4 for the sake of convenience. Referring to FIG. 4, it is assumed herein that the flange 14 is divided into an upper half portion and a lower half portion. The upper half portion is defined based on one side (i.e., an upper side) of the flange 14, while the lower half portion is defined based on an opposite side (i.e., a lower side) of the flange 14 with respect to the central axis J1. In other words, when the housing 10 is viewed from above the opening on the inlet side, the housing 10 can be divided into upper and lower halves at a line parallel or substantially parallel to two opposing sides of the housing 10 and passing through the central axis J1, and the upper and lower half portions of the flange 14 are defined on opposite sides of the line.

The side wall 11 includes three slit groups 111, 112, and 113 (specifically, a first slit group 111, a second slit group 112, and a third slit group 113) defined therein. The slit groups 111, 112, and 113 include a plurality of slits 111*a*, a plurality of slits 112*a*, and a plurality of slits 113*a*, respectively. The first and second slit groups 111 and 112 are defined in two of the corner corresponding surfaces 11*g* on the outer circumferential surface of the side wall 11. More specifically, the first slit group 111 is defined in one of the corner corresponding surfaces 11*g* which corresponds to the first corner portion 14*a* of the flange 14, while the second slit group 112 is defined in one of the corner corresponding surfaces 11*g* which corresponds to the second corner portion 14*b* of the flange 14. That is, the first and second slit groups 111 and 112 are arranged in portions of the side wall 11 which correspond to the two adjacent corner portions 14*a* and 14*b* in the upper half portion of the flange 14. The third slit group 113 is defined in a portion of the side wall 11 which corresponds to the lower half portion of the flange 14. More specifically, the third slit group 113 is arranged to extend over one of the side corresponding surfaces 11*f* which corresponds to the lower side of the flange 14 and two of the corner corresponding surfaces 11*g* which correspond to the third and fourth corner portions 14*c* and 14*d* of the flange 14, which are adjacent to the side corresponding surface 11*f*.

The slits 111*a*, 112*a*, or 113*a* in each of the slit groups 111, 112, and 113 are arranged in a circumferential direction of the side wall 11, and are arranged to extend through the side wall 11 from the straight surface 11*c* (i.e., the inner circumferential surface) to the corner corresponding surface 11*g* or the side corresponding surface 11*f* (i.e., the outer circumferential surface) of the side wall 11. The slits 111*a* in the first slit group 111 are arranged to extend in the same direction (i.e., have the same through direction T). The slits 112*a* in the second slit group 112 are arranged to extend in the same direction (i.e., have the same through direction T). The slits 113*a* in the third slit group 113 are arranged to extend in the same direction (i.e., have the same through direction T). The slits 111*a*, 112*a*, or 113*a* in each of the three slit groups 111, 112, and 113 have a different through direction T from that of the slits in any other of the three slit groups 111, 112, and 113. The longitudinal direction of each of the slits 111*a*, 112*a*, and 113*a* in the slit groups 111, 112, and 113, respectively, when viewed from a radial outside, is inclined at a specified angle to the direction parallel or substantially parallel to the central axis J1.

Figure 5:
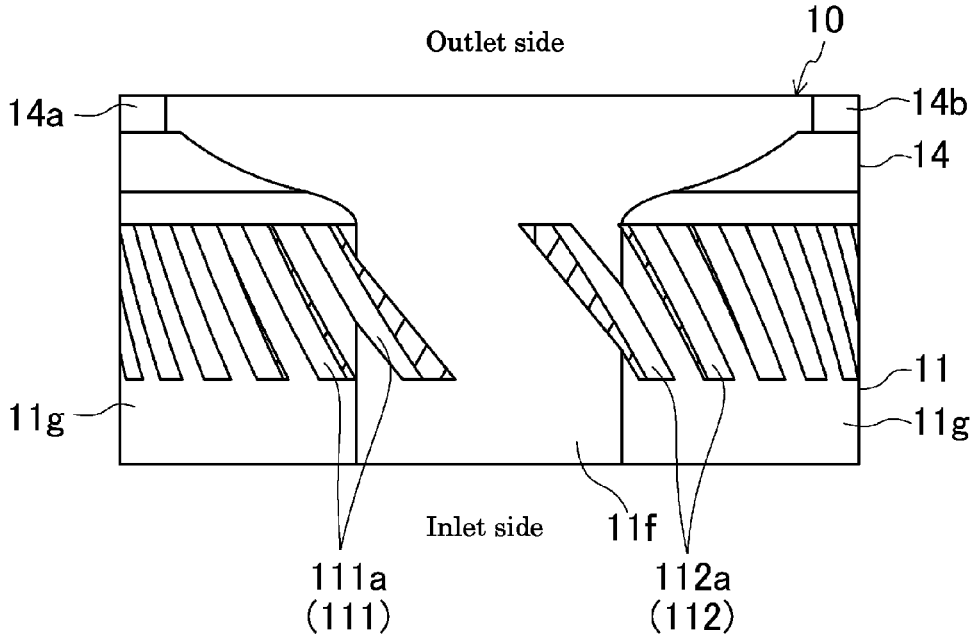
FIG. 5 is a side view of the housing of the axial fan according to the first preferred embodiment of the present invention.
Figure 6:
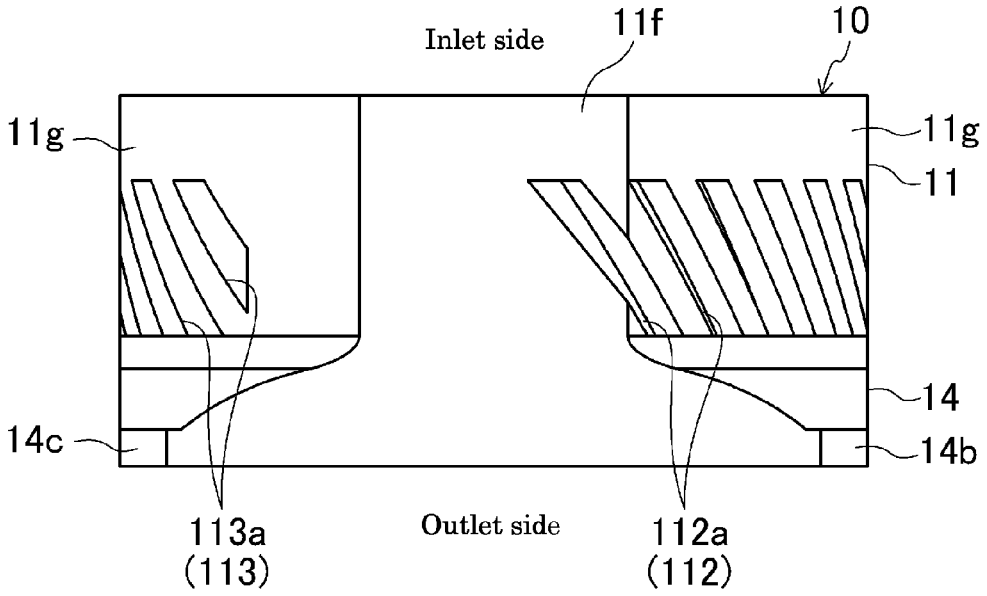
FIG. 6 is a side view of the housing of the axial fan according to the first preferred embodiment of the present invention.
Figure 7:
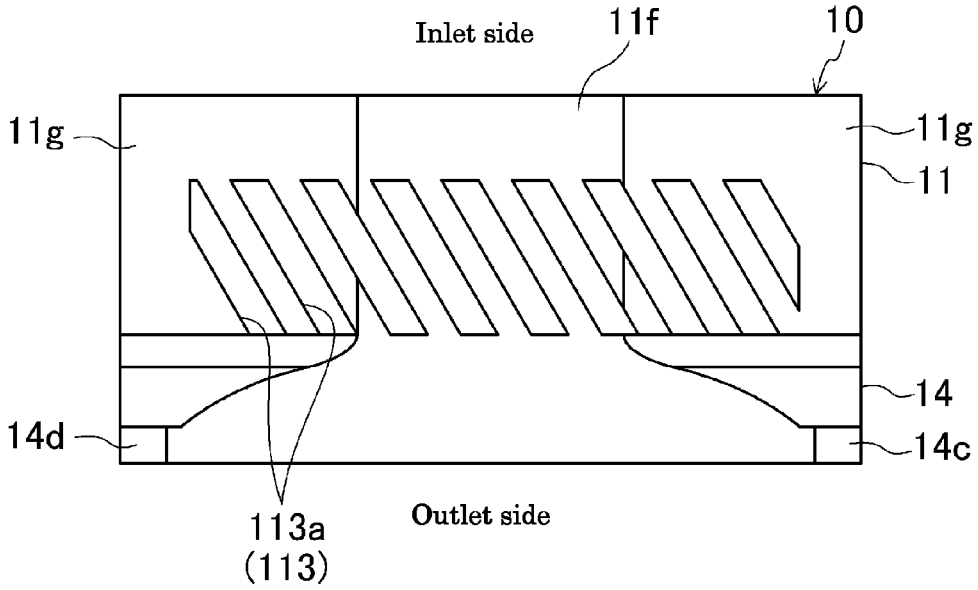
FIG. 7 is a side view of the housing of the axial fan according to the first preferred embodiment of the present invention.

Referring to FIGS. 5 and 6, each of the slits 111*a* which are arranged at circumferential ends of the first slit group 111 is arranged to extend over a corresponding one of the corner corresponding surfaces 11*g* and an adjacent one of the side corresponding surfaces 11*f*, and similarly, each of the slits 112*a* which are arranged at circumferential ends of the second slit group 112 is arranged to extend over a corresponding one of the corner corresponding surfaces 11*g* and an adjacent one of the side corresponding surfaces 11*f*. More specifically, when viewed from the radial outside, one end of the slit 111*a* or 112*a* in the longitudinal direction is positioned in the corner corresponding surface 11*g*, while the other end of the slit 111*a* or 112*a* in the longitudinal direction is positioned in the side corresponding surface 11*f*.

As described above, a portion of the side wall 11 which corresponds to the straight surface 11*c* is preferably circular, and the outer circumferential surface of the side wall is made up of the side corresponding surfaces 11*f*, each of which is preferably defined by a flat surface, and the corner corresponding surfaces 11*g*, each of which is defined by a substantially arc-shaped surface. Accordingly, a portion of the side wall 11 which corresponds to each side corresponding surface 11*f* has a thickness smaller than that of a portion of the side wall 11 which corresponds to each corner corresponding surface 11*g*.

Structure of Electronic Device

Figure 8:
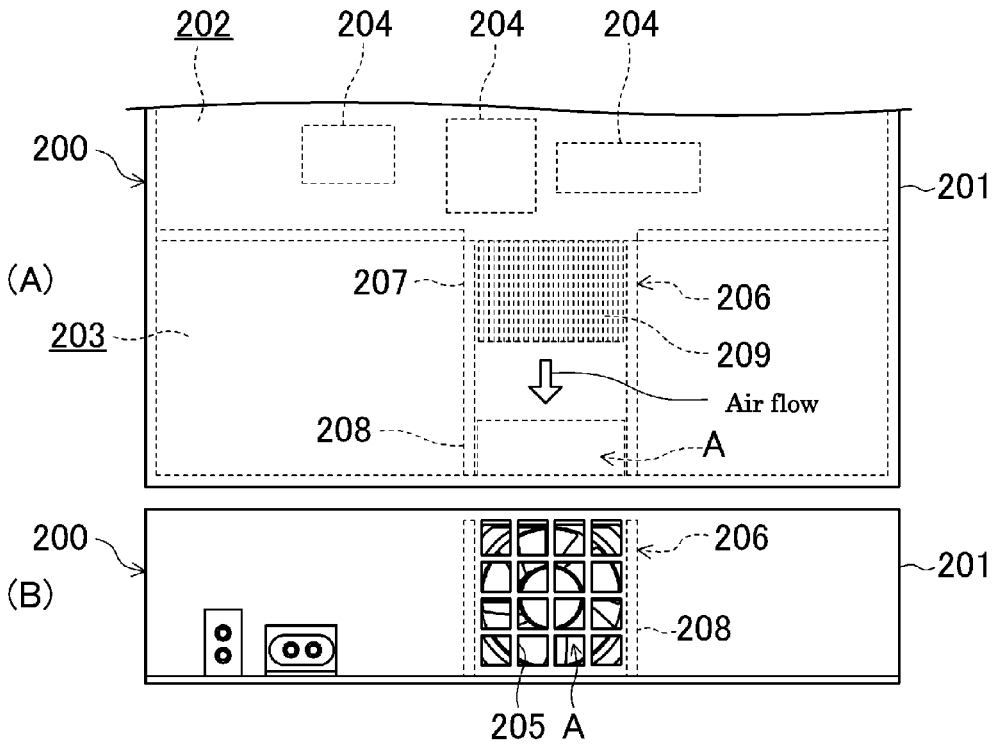
FIG. 8 includes (A) a plan view of an electronic device according to a preferred embodiment of the present invention, and (B) a front view of the electronic device.
Figure 9:
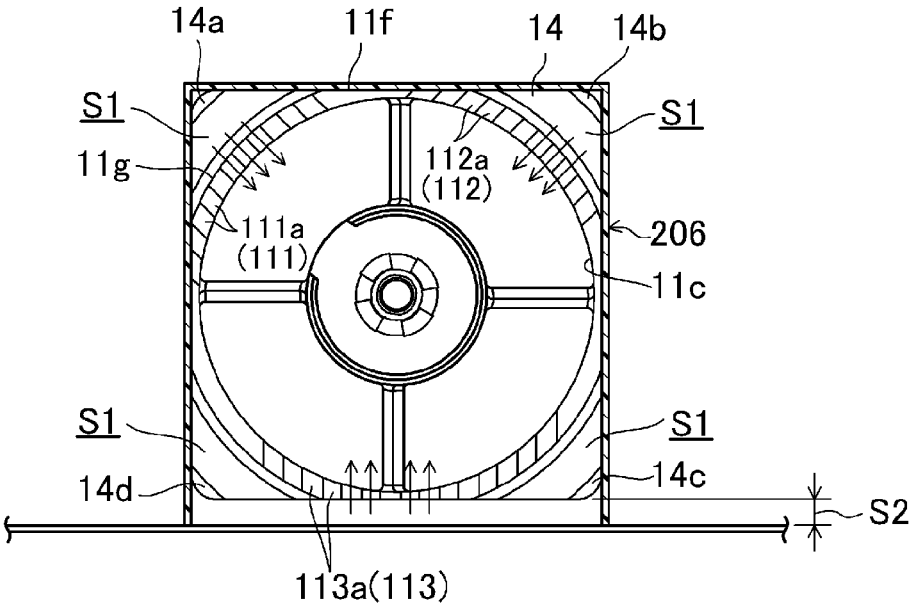
FIG. 9 is a front view of the axial fan according to the first preferred embodiment of the present invention attached to a duct of the electronic device, as viewed from the inlet side.

Next, the electronic device 200 according to the present preferred embodiment will now be described below with reference to FIGS. 8 and 9. The electronic device 200 is installed, for example, in a household electrical appliance or the like.

The electronic device 200 preferably includes the casing 201, and also includes heating elements 204, the duct 206, and the above-described axial fan A arranged inside the casing 201. An interior of the casing 201 is divided into an element space 202 in which the heating elements 204 are arranged, and a fan space 203 in which the duct 206 and the axial fan A are arranged. The axial fan A is attached to an inside of the duct 206, and the duct 206 is thus arranged to discharge an air having a high temperature inside the element space 202 to an outside of the casing 201. In the fan space 203, an air entrance portion 207 of the duct 206 is arranged to open into the element space 202, and an air exit portion 208 of the duct 206 is connected to an air outlet 205 defined in the casing 201. In addition, a heat sink 209 is arranged in the air entrance portion 207 of the duct 206.

The axial fan A is arranged in the air exit portion 208 of the duct 206. A cross-section (which defines a cross-section of an air channel) of the air exit portion 208 is preferably substantially square or substantially rectangular. The axial fan A is installed in the air exit portion 208 so as to cross the air channel. The width of the cross-section of the air exit portion 208 is approximately equal to the width of the flange 14 of the axial fan A. The height of the cross-section of the air exit portion 208 is slightly greater than the height of the flange 14 of the axial fan A, i.e., the distance between the side corresponding surface 11*f* corresponding to the upper side of the flange 14 and the side corresponding surface 11*f* corresponding to the lower side of the flange 14. As a result, referring to FIG. 9, a minute gap is defined between the duct 206 and each of the upper, right-hand, and left-hand side corresponding surfaces 11*f* of the side wall 11 of the axial fan A. In addition, a gap S1 is defined between the duct 206 and each of the four corner corresponding surfaces 11*g* of the side wall 11, while a gap S2 is defined between the duct 206 and the lower side corresponding surface 11*f*. That is, the axial fan A is installed in the air exit portion 208 of the duct 206 such that the first and second slit groups 111 and 112 are arranged on an upper side, that each of the upper side and lateral sides of the flange 14 and a channel wall together define the minute gap therebetween, and that the lower side of the flange 14 and the channel wall together define the gap S2 therebetween. Note that the minute gaps mentioned above are clearance spaces needed for the attachment of the axial fan A to the duct 206, and that the gap S2 is significantly greater than these minute gaps.

According to the present preferred embodiment, because the gaps S1 are defined outside the corner corresponding surfaces 11*g* of the side wall 11, those of the slits 111*a*, 112*a*, and 113*a* in the slit groups 111, 112, and 113 which are defined in the corner corresponding surfaces 11*g* permit entry of an sufficient amount of air therethrough. Moreover, because the gap S2 is defined outside those of the slits 113*a* in the third slit group 113 which are defined in the lower side corresponding surface 11*f*, a sufficient amount of air is permitted to enter through these slits 113*a*. That is, the entry of a sufficient amount of air through the slits 113*a* in the third slit group 113 is ensured by both of the gaps S1 and the gap S2. As described above, even when the axial fan A is attached to the rectangular duct 206, the entry of a sufficient amount of air is accomplished through the slits 111*a*, 112*a*, and 113*a* because the slits 111*a*, 112*a*, and 113*a* are mostly defined in those portions of the side wall 11 which have the gaps S1 outside such that portions of the duct 206 cannot completely cover the slits 111*a*, 112*a*, and 113*a* to thereby present the flow of air there into. This results in a sufficient air intake effect of the slits 111*a*, 112*a*, and 113*a*. This enables the axial fan A as a whole to achieve a sufficient air volume. Note that, in a modification of the present preferred embodiment, the slits 113*a* in the third slit group 113 may be defined only in the side corresponding surface 11*f* corresponding to the lower side of the flange 14. Also note that, in a modification of the present preferred embodiment, the slits 113*a* in the third slit group 113 may be defined only in one of the adjacent corner corresponding surfaces 11*g*.

In each of the first and second slit groups 111 and 112, the slits 111*a* or 112*a* which are arranged at both circumferential ends thereof are arranged to extend over the corresponding one of the corner corresponding surfaces 11*g* and the adjacent one of the side corresponding surfaces 11*f*. Regarding each of these slits 111*a* and 112*a*, an outside of a portion thereof which is positioned in the side corresponding surface 11*f* is covered by the duct 206, and therefore, air does not enter through this portion. However, because the gap S1 exists outside a portion thereof which is positioned in the corner corresponding surface 11*g*, air is allowed to enter through this portion and exit through the entire opening on the outlet side, making it possible for a sufficient amount of air to enter into the axial fan A. Therefore, there is no need to prevent a portion of any of the slits 111*a* and 112*a* from extending over any side corresponding surface 11*f*, and this makes it possible to increase the number of slits 111*a* or 112*a*.

In contrast to the present preferred embodiment, in the case where the outer circumferential surface of the side wall 11 is arranged to be entirely cylindrical so that a cross-section of the side wall 11 taken along a plane perpendicular to the central axis J1 has a uniform thickness throughout, for example, regarding each slit group made up of a plurality of slits arranged in the circumferential direction and having the same through direction T, the dimensions along the through direction T of slits that are closer to either circumferential end of the slit group are greater than those of slits that are closer to the middle of the slit group. The dimension of each slit along the through direction T corresponds to the length of an air channel through the slit. Thus, the slits that are relatively close to either circumferential end of the slit group involve a relatively large air channel resistance. In the axial fan A according to the present preferred embodiment, however, the outer circumferential surface of the side wall 11 is made up of the side corresponding surfaces 11*f*, each of which is preferably defined by a flat surface, and the corner corresponding surfaces 11*g*, each of which is preferably defined by an arc-shaped surface, and portions of the side wall 11 which correspond to the side corresponding surfaces 11*f* are arranged to have a smaller thickness than that of portions of the side wall 11 which correspond to the corner corresponding surfaces 11*g*. Therefore, within each of the slit groups 111, 112, and 113, the slits 111*a*, 112*a*, or 113*a* which are arranged to extend over the corresponding one of the corner corresponding surfaces 11*g* and the adjacent one of the side corresponding surfaces 11*f* (especially, those which are arranged at both circumferential ends of the slit group) have a reduced thickness along the through direction T, that is, a shorter air channel therethrough, and hence a reduced air channel resistance.

Furthermore, air that stays on the inlet side of the axial fan A flows into a space inside the side wall 11 through the inner circumferential surface of the side wall 11, more specifically, the inclined surfaces 11*a* and 11*d*. A cross-sectional area (i.e., a cross-sectional area of the air channel) of the inner circumferential surface of the side wall 11 which is perpendicular or substantially perpendicular to the central axis J1 is smaller at levels at which the straight surface 11*c* is defined than at levels at which the inclined surfaces 11*a* and 11*d* are defined. Therefore, in accordance with Bernoulli's theorem, a flow of air passing through the straight surface 11*c* has a greater flow velocity than that of a flow of air passing through the inclined surfaces 11*a* and 11*d*. Because the flow of air passing through the straight surface 11*c* has a greater flow velocity than that of a flow of air in any other region, a negative pressure is generated relative to an atmospheric pressure in a region around the side wall 11. This makes it easier for air to flow into the space inside the inner circumferential surface of the side wall 11 through the slits 111*a*, 112*a*, and 113*a* in the slit groups 111, 112, and 113, respectively. The air then passes through the straight surface 11*c* and the inclined surfaces 11*b* and 11*e* to be discharged out of the axial fan A. Here, the cross-sectional area (i.e., the cross-sectional area of the air channel) of the inner circumferential surface of the side wall 11 which is perpendicular or substantially perpendicular to the central axis J1 is greater at levels at which the inclined surfaces 11*b* and 11*e* are defined than at the levels at which the straight surface 11*c* is defined. This contributes to an increase in the volume or air being discharged.

Second Preferred Embodiment

Figure 10:
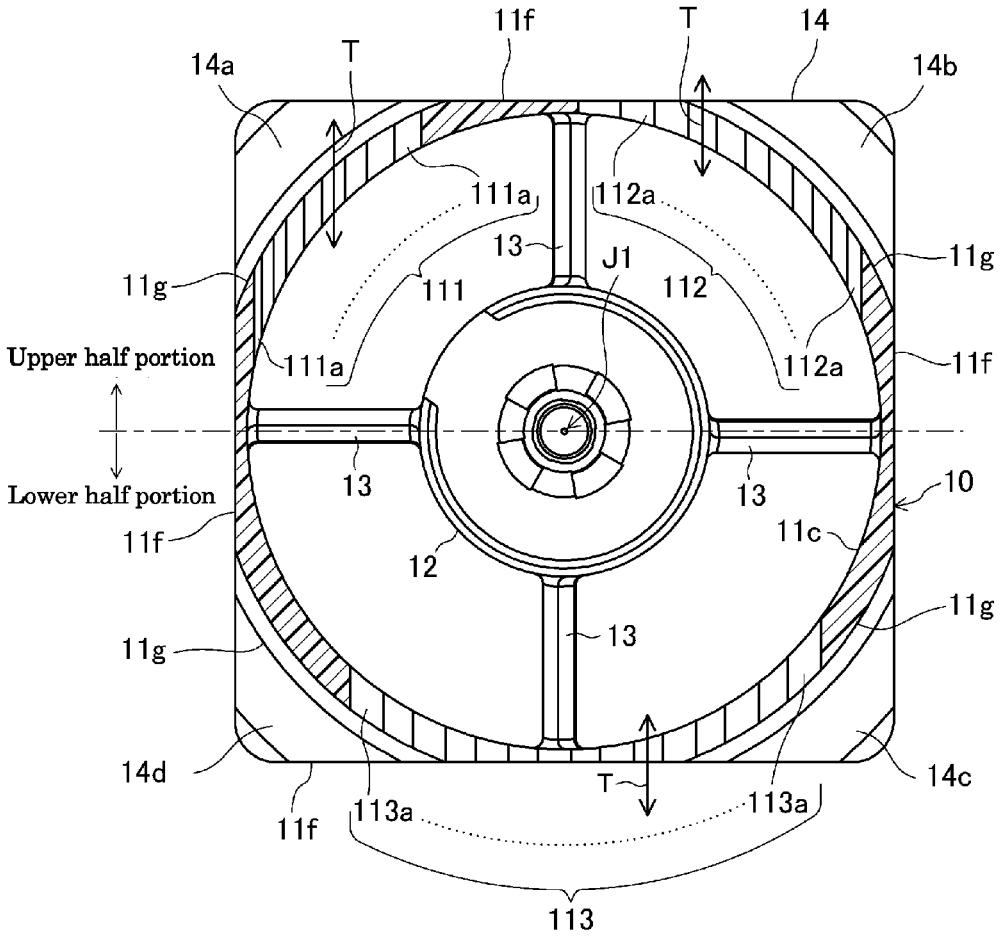
FIG. 10 is a cross-sectional view of a housing of an axial fan according to a second preferred embodiment of the present invention in a cross-section taken along a plane perpendicular to the central axis J1.

A second preferred embodiment of the present invention will now be described below with reference to FIG. 10. An axial fan A according to the present preferred embodiment is similar to the axial fan A according to the first preferred embodiment described above except in the structures of the first and second slit groups 111 and 112.

In the present preferred embodiment, all of the slits 111*a* and 112*a* in the first and second slit groups 111 and 112, respectively, have the same through direction T. Therefore, it is possible to arrange a mold that is used to define the slits 111*a* and a mold that is used to define the slits 112*a* through, for example, injection molding to be slid in the same direction at the time of mold release. A mold release operation of the present preferred embodiment is thereby made easier than a mold release operation of the previously described preferred embodiment. Other structural features, actions, and effects of the present preferred embodiment are similar to those of the first preferred embodiment described above.

Third Preferred Embodiment

Figure 11:
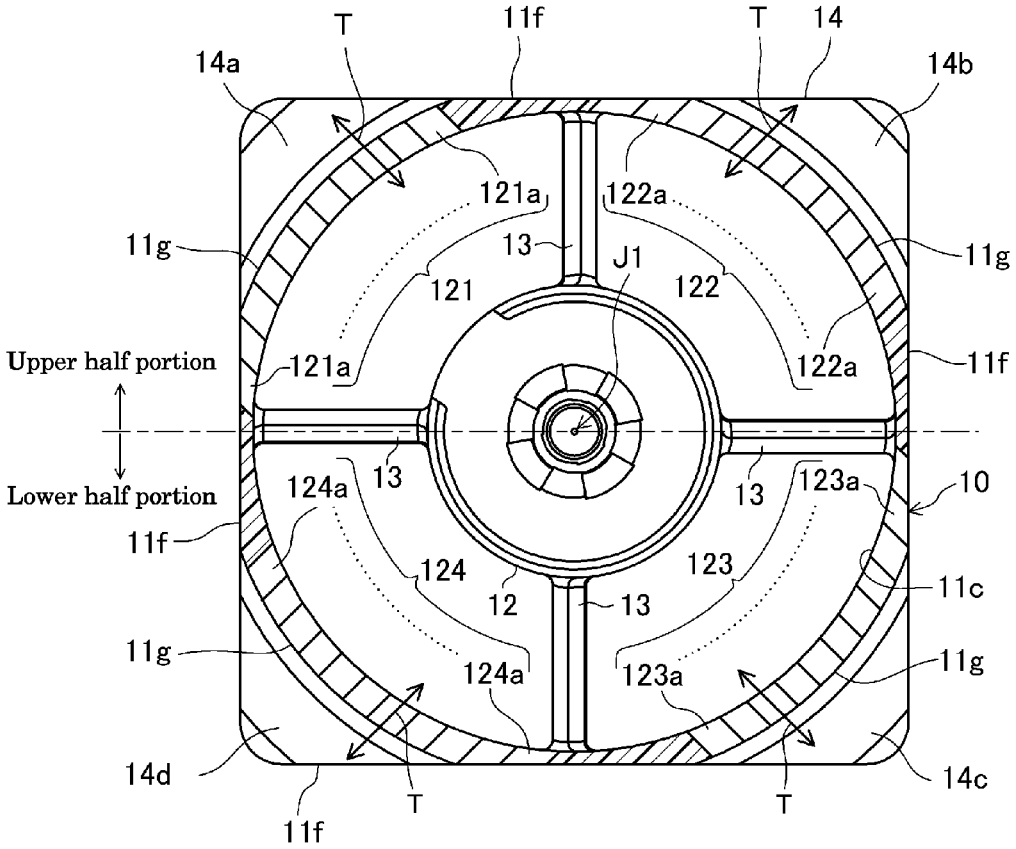
FIG. 11 is a cross-sectional view of a housing of an axial fan according to a third preferred embodiment of the present invention in a cross-section taken along a plane perpendicular to the central axis J1.

A third preferred embodiment of the present invention will now be described below with reference to FIG. 11. An axial fan A according to the present preferred embodiment is similar to the axial fan A according to the first preferred embodiment described above except that the number of slit groups is preferably changed from three to four.

The side wall 11 according to the present preferred embodiment includes four slit groups 121, 122, 123, and 124 (specifically, a first slit group 121, a second slit group 122, a third slit group 123, and a fourth slit group 124) defined therein. The slit groups 121, 122, 123, and 124 preferably include a plurality of slits 121*a*, a plurality of slits 122*a*, a plurality of slits 123*a*, and a plurality of slits 124*a*, respectively. Each of the four slit groups 121, 122, 123, and 124 is defined in a separate one of the four corner corresponding surfaces 11*g* on the outer circumferential surface of the side wall 11. More specifically, as in the first preferred embodiment described above, the first and second slit groups 121 and 122 are defined in the corner corresponding surfaces 11*g* corresponding to the first and second corner portions 14*a* and 14*b*, respectively, of the flange 14. The third slit group 123 is defined in the corner corresponding surface 11*g* corresponding to the third corner portion 14*c* of the flange 14. The fourth slit group 124 is defined in the corner corresponding surface 11*g* corresponding to the fourth corner portion 14*d* of the flange 14. That is, the first and second slit groups 121 and 122 are arranged in portions of the side wall 11 which correspond to the two adjacent corner portions 14*a* and 14*b* in the upper half portion of the flange 14. The third and fourth slit groups 123 and 124 are arranged in portions of the side wall 11 which correspond to the two adjacent corner portions 14*c* and 14*d* in the lower half portion of the flange 14.

Also in the present preferred embodiment, even when the axial fan A is attached to the rectangular duct 206, the entry of a sufficient amount of air is accomplished through each of the slit groups 121, 122, 123, and 124 because the gap S1 is defined outside each of the four corner corresponding surfaces 11*g* of the side wall 11. This results in a sufficient air intake effect of the slits 121*a*, 122*a*, 123*a*, and 124*a*. This enables the axial fan A as a whole to achieve a sufficient air volume. In the case of the axial fan A according to the present preferred embodiment, the entry of a sufficient amount of air through each of the third and fourth slit groups 123 and 124 is accomplished even if the axial fan A is attached not to the duct 206 according to the first preferred embodiment described above but to a duct which is so shaped that the lower side corresponding surface 11*f* of the side wall 11 is arranged substantially in contact with the duct without the gap S2 defined between the duct and the flange 14. Other structural features, actions, and effects of the present preferred embodiment are similar to those of the first preferred embodiment described above.

Fourth Preferred Embodiment

Figure 12:
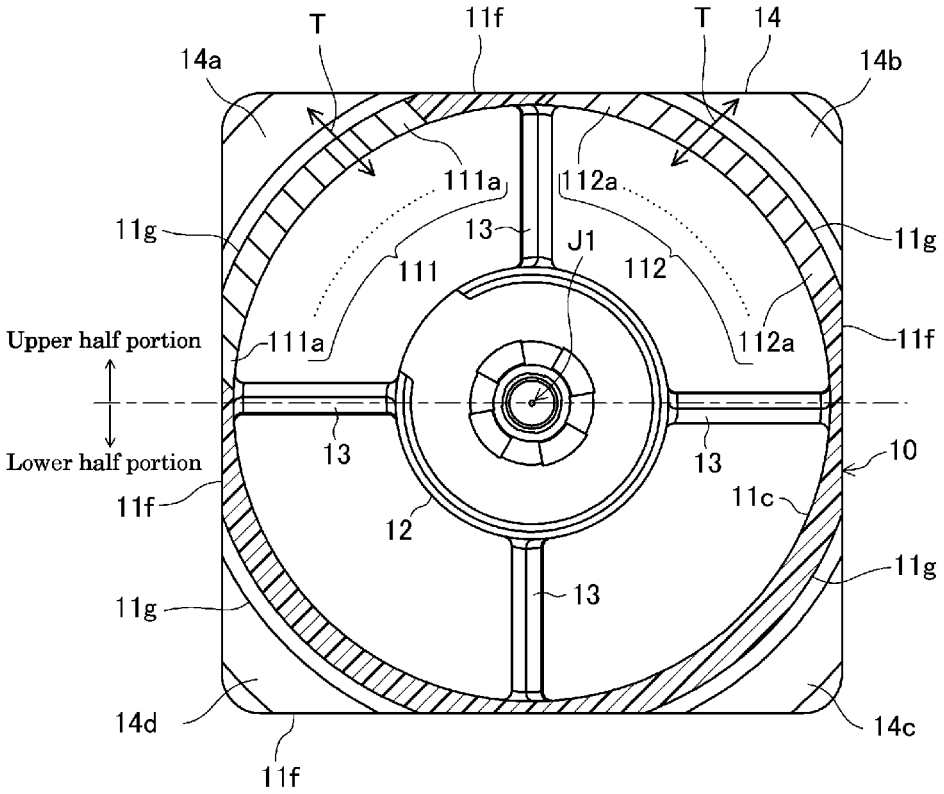
FIG. 12 is a cross-sectional view of a housing of an axial fan according to a fourth preferred embodiment of the present invention in a cross-section taken along a plane perpendicular to the central axis J1.

A fourth preferred embodiment of the present invention will now be described below with reference to FIG. 12. An axial fan A according to the present preferred embodiment is similar to the axial fan A according to the first preferred embodiment described above except that the third slit group 113 is eliminated, leaving only the first and second slit groups 111 and 112. Even in this case, the entry of a sufficient amount of air is accomplished through each of the slit groups 111 and 112, and a sufficient air intake effect of the slits 111*a* and 112*a* is achieved. Other structural features, actions, and effects of the present preferred embodiment are similar to those of the first preferred embodiment described above.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An axial fan comprising:

an impeller arranged to rotate about a central axis, and including a plurality of blades centered on the central axis, arranged to project radially outward, and arranged in a circumferential direction; and a housing including a side wall arranged to include openings at first and second axial ends thereof and arranged to surround an outer circumference of the impeller, the side wall including at least one flat portion, and a substantially square or substantially rectangular flange arranged to project radially outward from an outer circumferential surface of the side wall, the side wall including an opening end at the axial end thereof on an inlet side and another opening end at the axial end thereof on an outlet side, the flange being arranged on the opening end on the inlet side or on the opening end on the outlet side; wherein the side wall includes at least three slit groups and at least three slitless portions, each of the at least three slit groups includes a plurality of slits arranged in the circumferential direction and arranged to extend through the side wall from an inner circumferential surface to the outer circumferential surface thereof; and two of the at least three slit groups are respectively provided in two adjacent corner portions of the side wall in a first radially extending half portion of the flange with the at least one flat portion provided between the two adjacent corner portions and including one of the at least three slitless portions, while a remaining slit group of the at least three slit groups is provided in a portion of the side wall in a second radially extending half portion of the flange, the first radially extending and second radially extending half portions being divided at a line parallel or substantially parallel to two opposing sides of the flange and passing through the central axis.

2. The axial fan according to claim 1, wherein, within each of the at least three slit groups, each of the plurality of slits extends in an identical through direction.

3. The axial fan according to claim 1, wherein the inner circumferential surface of the side wall is cylindrical;

the outer circumferential surface of the side wall includes side surfaces and corner surfaces, each of the side surfaces being the at least one flat portion and arranged to extend along a separate one of four sides of the flange, each of the corner surfaces being a separate one of four corner portions of the flange;

a longitudinal direction of each of the plurality of slits in each of the two of the at least three slit groups defined in the portions of the side wall which include the two corner portions of the flange is inclined with respect to a direction parallel or substantially parallel to the central axis; and at least those of the plurality of slits in each of the two of the at least three slit groups which are arranged at both ends of the respective slit group are each arranged to extend, on the outer circumferential surface of the side wall, over a corresponding one of the corner surfaces and an adjacent one of the side surfaces.

4. The axial fan according to claim 1, wherein portions of the side wall at and near the opening end on the inlet side are arranged to have a tapered or substantially tapered shape such that a cross-sectional area of the opening defined thereby increases with decreasing distance from the opening end on the inlet side.

5. The axial fan according to claim 1, wherein portions of the side wall at and near the opening end on the outlet side is arranged in a tapered or substantially tapered shape such that a cross-sectional area of the opening defined thereby increases with decreasing distance from the opening end on the outlet side.

6. The axial fan according to claim 2, wherein the plurality of slits in each of the at least three slit groups extend in a different through direction from through directions in which the plurality of slits in others of the at least three slit groups extend.

7. The axial fan according to claim 2, wherein the plurality of slits in each of the two of the at least three slit groups provided in the two corner portions of the flange extend in the same through direction as that of the plurality of slits in the other of the two of the at least three slit groups.

8. The axial fan according to claim 3, wherein portions of the side wall which include the side surfaces have a thickness that is smaller than a corresponding thickness of portions of the side wall which include the corner surfaces.

9. The axial fan according to claim 1, wherein the side wall includes four of the slit groups each of which includes a plurality of slits arranged in the circumferential direction and arranged to extend through the side wall from an inner circumferential surface to the outer circumferential surface thereof; and two of the four slit groups are provided in two adjacent corner portions of the side wall in the first radially extending half portion of the flange, while the remaining two of the four slit groups are provided in two additional adjacent corner portions of the side wall in the second radially extending half portion of the flange, arranged oppositely from the first radially extending half portion of the flange, the first radially extending and second radially extending half portions being divided at a line parallel or substantially parallel to two opposing sides of the flange and passing through the central axis.

10. An electronic device comprising:

a casing;

a heating element arranged inside the casing;

the axial fan of claim 1 arranged inside the casing; and a duct including the axial fan attached thereto, and arranged inside the casing to discharge an air out of the casing, the duct including an air channel with a substantially square or substantially rectangular cross-section; wherein the axial fan is attached to the duct such that the two of the at least three slit groups provided in the two corner portions of the flange of the axial fan are arranged on a first radially extending side within the air channel, that each of the first radially extending half portion and lateral sides of the flange of the axial fan and a channel wall of the air channel together define a minute gap therebetween, and that the second radially extending half portion of the flange of the axial fan and the channel wall together define a gap therebetween, the gap being larger than the minute gap.

* * * * *